US006196392B1

(12) United States Patent
Lopez et al.

(10) Patent No.: US 6,196,392 B1
(45) Date of Patent: Mar. 6, 2001

(54) METHOD AND APPARATUS FOR FEEDING AND TABBING INTERMIXED PIECES OF MAIL

(75) Inventors: Steven Wynn Lopez, Orlando, FL (US); Daniel Wayne Barber, Cambridge (CA)

(73) Assignee: Profold, Inc., Sebastian, FL (US)

( * ) Notice: Subject to any disclaimer, the term of this patent is extended or adjusted under 35 U.S.C. 154(b) by 0 days.

(21) Appl. No.: 08/997,565

(22) Filed: Dec. 23, 1997

(51) Int. Cl.[7] ..... B07C 5/02; B31F 5/00

(52) U.S. Cl. ..... 209/540; 209/900; 156/212; 156/443

(58) Field of Search ..... 270/58.09; 156/212, 156/216, 443, 475, 477.1; 209/540, 552, 900

(56) References Cited

U.S. PATENT DOCUMENTS

| | | | |
|---|---|---|---|
| 2,145,334 | 1/1939 | Bergstein | 93/1 |
| 2,781,818 | 2/1957 | Beckman et al. | 154/1.8 |
| 3,966,193 | 6/1976 | Storace et al. | 271/150 |
| 4,119,194 | 10/1978 | Freeman et al. | 198/400 |
| 4,121,403 | 10/1978 | Bogdanski et al. | 53/202 |
| 4,140,627 | 2/1979 | Weller et al. | 209/3.3 |
| 4,183,779 | 1/1980 | Barber et al. | 156/361 |
| 4,278,488 | 7/1981 | Kopacz et al. | 156/351 |
| 4,588,463 | 5/1986 | Barber et al. | 156/200 |
| 4,606,715 | 8/1986 | Larson | 425/110 |
| 4,621,798 | 11/1986 | Akers | 271/5 |
| 4,669,719 | 6/1987 | Frantangelo | 271/251 |
| 4,701,238 | 10/1987 | Boucher | 156/479 |
| 4,750,966 | 6/1988 | Koller | 156/391 |
| 4,795,042 | 1/1989 | Klein et al. | 211/186 |
| 4,930,764 | 6/1990 | Holbrook et al. | 271/119 |
| 4,955,483 | 9/1990 | O'Dea et al. | 208/548 |
| 4,971,686 | 11/1990 | O'Dea et al. | 209/548 |
| 4,973,037 | 11/1990 | Holbrook | 271/2 |
| 5,114,137 | 5/1992 | Olson | 271/251 |
| 5,214,901 * | 6/1993 | Milliner | 53/397 |
| 5,294,100 * | 3/1994 | Scheibelhut | 270/58.09 |
| 5,393,366 | 2/1995 | Bell | 156/443 |
| 5,398,922 | 3/1995 | Malatesta | 271/11 |
| 5,595,044 | 1/1997 | Kataigi | 53/396 |
| 5,630,899 | 5/1997 | Meschi | 156/217 |
| 5,891,300 | 4/1999 | Oussani, Jr. et al. | 156/541 |

OTHER PUBLICATIONS

Video Tape Memphis DIV Installation & Training; Sam Lusk, Postal Mgr. (901) 521–2219; Jul. 1992.
Video Tape "U.S.P.S. Tabbing Machine".

* cited by examiner

*Primary Examiner*—Tuan N. Nguyen
(74) *Attorney, Agent, or Firm*—Allen, Dyer, Doppelt, Milbrath & Gilchrist, P.A.

(57) ABSTRACT

A method and apparatus are provided for feeding and tabbing intermixed pieces of mail. A method preferably includes positioning a plurality of intermixed pieces of mail having a plurality of different widths, lengths, and thicknesses so that each of the plurality of intermixed pieces of mail has a commonly-oriented edge to be tabbed. The commonly-oriented edge to be tabbed is preferably defined as being the side of a piece of mail generally perpendicular to the address orientation when reading the address of the piece of mail. The method also preferably includes positioning at least one tab on each of the plurality of intermixed pieces of mail. An apparatus for feeding and tabbing intermixed pieces of mail preferably includes an intermixed mail feeder for feeding a plurality of intermixed pieces of mail having a plurality of different widths, lengths, and thicknesses so that each of the plurality of intermixed pieces of mail has a commonly-oriented edge to be tabbed. The commonly-oriented edge to be tabbed is preferably defined as being the side of a piece of mail being generally perpendicular to the address orientation when reading the address of the piece of mail. The apparatus also preferably includes a tabber positioned downstream from the intermixed mail feeder and directly aligned with and adjacent the commonly-oriented edge to be tabbed for positioning at least one tab on each of the plurality of intermixed pieces of mail.

40 Claims, 11 Drawing Sheets

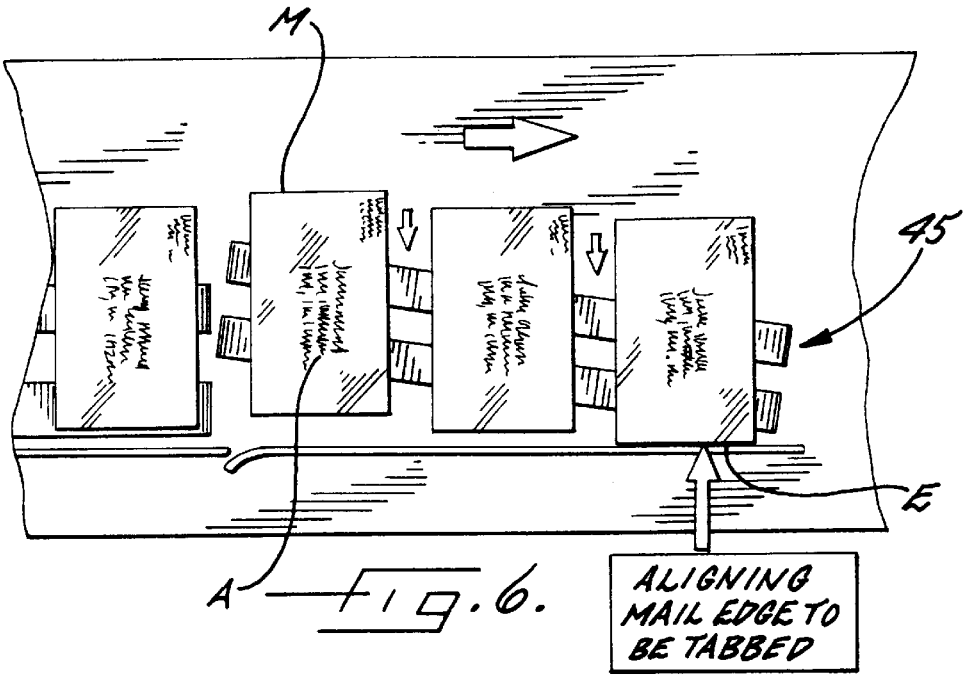
Fig. 6.
Fig. 7.
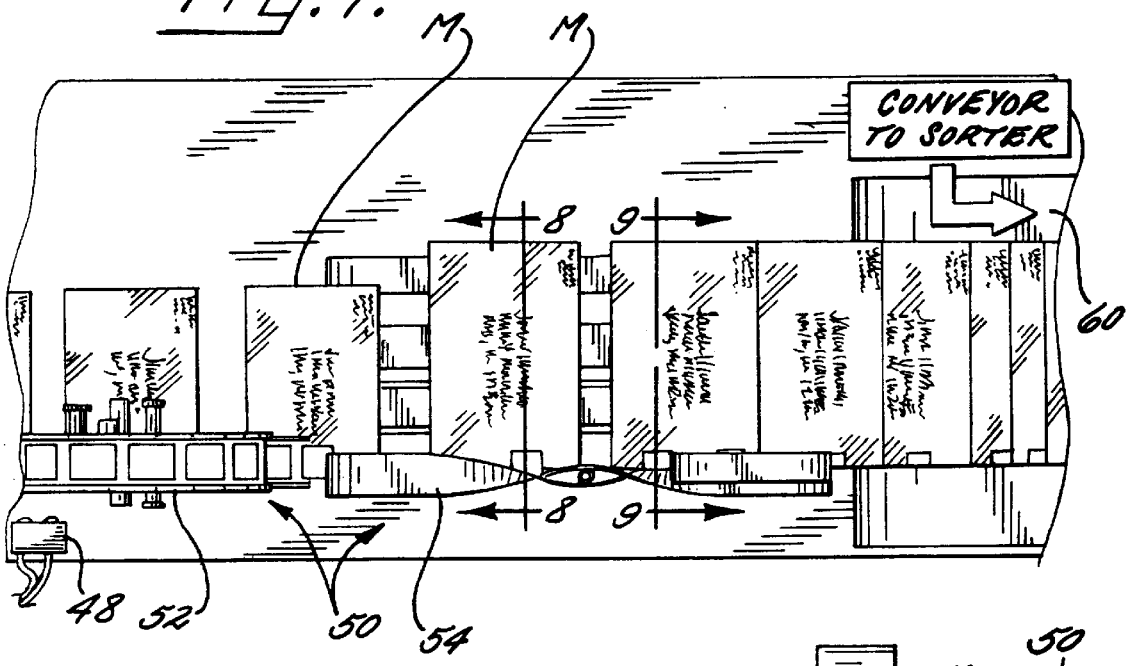
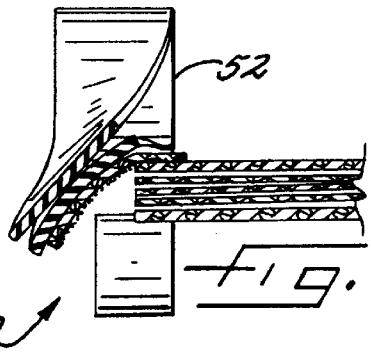
Fig. 8.
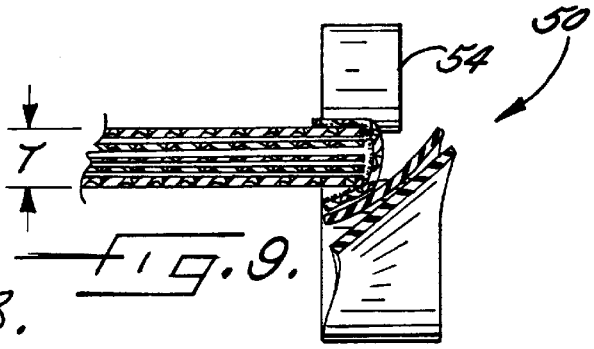
Fig. 9.

| MAIL ORIENTED IN FEEDER | PRESENCE OF ORIENTOR | LEFT OR RIGHT TAB |
|---|---|---|
| FRONT | YES | RIGHT |
| REAR | YES | LEFT |
| BOTTOM | NO | RIGHT |
| TOP | NO | LEFT |

FIG. 16.

METHOD AND APPARATUS FOR FEEDING AND TABBING INTERMIXED PIECES OF MAIL

FIELD OF THE INVENTION

The invention relates to the field of article handling and, more particularly, to the field of handling intermixed pieces of mail.

BACKGROUND OF THE INVENTION

Over the years, various mail feeding, handling, and sorting systems have been developed for feeding, handling, and sorting pieces of mail. Adhesive tabs or seals have also been used to close or seal the loose edges of a paper, brochure, envelope, magazine or other articles of mail being handled or transported. The loose edge of a piece of mail, for example, is closed or sealed to allow the mail to be handled by feeding and processing machinery and to provide a degree of confidential nature to the closed or sealed mail. Increasing the speed and accuracy of placement of these tabs, however, has become more important as mail quantities increase, as labor becomes more expensive, and as more and improved automation is desired.

In order to provide significant improvements in the speed and efficiency in placing of these tabs, systems were developed for aligning and tabbing mail. An example of such a system can be seen in U.S. Pat. No. 5,393,366 by Bell titled "Aligning And Tabbing Method And Apparatus." This patent is also assigned to the same assignee of the present application. This patent describes an apparatus which rotates an article 90 degrees to be aligned properly to receive tabs.

Mail, however, can vary significantly in thicknesses, material substrates, e.g., coated or slick stock, recycled paper, bond stock, newsprint, and booklets, widths, and lengths. Tabbing or sealing such a variety of or intermixed pieces of mail can be difficult. Accordingly, there still exists a need for a method and system for a more efficient and quicker method and apparatus for selectively feeding and tabbing intermixed pieces of mail and still having some assurance that a selected edge thereof will be quickly and efficiently tabbed or sealed.

SUMMARY OF THE INVENTION

In view of the foregoing background, the present invention advantageously provides a method and apparatus for quickly and efficiently tabbing or sealing a selected edge of intermixed pieces of mail. The present invention also advantageously provides a method and apparatus for feeding, aligning, and tabbing intermixed pieces of mail having a plurality of different widths, lengths, and thicknesses.

More particularly, the present invention provides a method of feeding and tabbing intermixed pieces of mail which preferably includes positioning a plurality of intermixed pieces of mail having a plurality of different widths, lengths, and thicknesses so that each of the plurality of intermixed pieces of mail has a commonly-oriented edge to be tabbed. The commonly-oriented edge to be tabbed is preferably defined as an edge or side being generally perpendicular to the address of the piece of mail or when reading the address of the piece of mail. Each piece of mail is also preferably positioned so as to have a common orientation with respect to a predetermined path of travel. The method also includes positioning at least one tab on each of the plurality of intermixed pieces of mail.

Another method of feeding and tabbing intermixed pieces of mail according to the present invention preferably includes providing a feeder for feeding a plurality of intermixed pieces of mail downstream and positioning a plurality of intermixed pieces of mail having a plurality of different widths, lengths, and thicknesses in the feeder so that each of the plurality of intermixed pieces of mail has a commonly-oriented edge to be tabbed. The method also preferably includes positioning a tabber downstream from the feeder and directly aligned with and adjacent the commonly-oriented edge to be tabbed. The method further preferably includes conveying the plurality of intermixed pieces of mail downstream to the tabber without rotating each of the plurality of pieces of mail and positioning at least one tab on each of the plurality of intermixed pieces of mail being conveyed.

Yet another method of feeding and tabbing intermixed pieces of mail according to the present invention preferably includes providing a feeder for feeding a plurality of intermixed pieces of mail downstream and positioning a plurality of intermixed pieces of mail having a plurality of different widths, lengths, and thicknesses in the feeder so that each of the plurality of intermixed pieces of mail has a commonly-oriented edge to be tabbed. The positioning of the plurality of intermixed pieces preferably includes aligning each of the plurality of intermixed pieces of mail so that the lead edge or side of each piece of mail being fed downstream comprises the commonly-oriented edge to be tabbed. The method also preferably includes positioning at least one tab on each of the plurality of intermixed pieces of mail.

A further method of feeding and tabbing intermixed pieces of mail according to the present invention preferably includes providing a feeder for feeding a plurality of intermixed pieces of mail downstream and positioning a plurality of intermixed pieces of mail having a plurality of different widths, lengths, and thicknesses in the feeder so that each of the plurality of intermixed pieces of mail has a commonly-oriented, unsealed edge to be tabbed. The commonly-oriented, unsealed edge to be tabbed is preferably defined as either the right side or the left side of a piece of mail, e.g., generally perpendicular to the address orientation when reading the address of the piece of mail. The positioning of the plurality of intermixed pieces preferably includes aligning each of the plurality of intermixed pieces of mail so that the lead edge being fed downstream comprises the commonly-oriented, unsealed edge to be tabbed. The method also preferably includes conveying each of the plurality of intermixed and aligned pieces of mail downstream and positioning at least one tab on each of the plurality of intermixed pieces of mail.

The present invention also provides an apparatus for feeding and tabbing intermixed pieces of mail. The apparatus preferably includes intermixed mail feeding means for feeding a plurality of intermixed pieces of mail having a plurality of different widths, lengths, and thicknesses so that each of the plurality of intermixed pieces of mail has a commonly-oriented edge to be tabbed. The commonly-oriented edge to be tabbed is preferably defined as being generally perpendicular to the address of the piece of mail or when reading the address of the piece of mail. The apparatus also includes tabbing means positioned downstream from the feeding means and directly aligned with and adjacent the commonly-oriented edge to be tabbed for positioning at least one tab on each of the plurality of intermixed pieces of mail. The apparatus can further include conveying means positioned downstream from the feeding means for conveying the plurality of intermixed pieces of mail directly to the tabbing means without rotation of each of the plurality of intermixed pieces of mail.

The present invention also advantageously includes a method of tabbing a plurality of intermixed pieces of mail. The method preferably includes sensing the length of each edge to be tabbed of a plurality of intermixed pieces of mail. The intermixed pieces of mail preferably have at least a plurality of lengths and widths. The method also includes locating at least one predetermined region of each edge to be tabbed of the plurality of intermixed pieces of mail responsive to the length thereof and positioning at least one tab onto each of the plurality of intermixed pieces of mail at the at least one predetermined region.

The apparatus and method advantageously enhance the speed and efficiency of mail flowing downstream or through mail handling or sorting operation such as associated with postal services. The feeding and tabbing according to the method of the present invention, for example, can seal mail on the leading edge or side for ease of handling or sorting with other automated mail handling or sorting equipment.

BRIEF DESCRIPTION OF THE DRAWINGS

Some of the features, advantages, and benefits of the present invention having been stated, others will become apparent as the description proceeds when taken in conjunction with the accompanying drawings in which:

FIG. 6 is a fragmentary top plan view of an apparatus for feeding and tabbing intermixed pieces of mail and illustrating alignment or registration of mail such as after being rotated according to a first embodiment of the present invention;

FIG. 7 is a fragmentary top plan view of an apparatus for feeding and tabbing intermixed pieces of mail and illustrating mail being tabbed and conveyed to a sorter and having a tabber on the right side thereof according to a first embodiment of the present invention;

FIG. 8 is a sectional view of an apparatus for feeding and tabbing intermixed pieces of mail taken along line 8—8 of FIG. 7 according to a first embodiment of the present invention;

FIG. 9 is a sectional view of an apparatus for feeding and tabbing intermixed pieces of mail taken along line 9—9 of FIG. 7 according to a first embodiment of the present invention;

FIG. 16 is a table illustrating a plurality of positions of a feeder, an orientor, and a tabber of an apparatus for feeding and tabbing intermixed pieces of mail according to first, second, third, and fourth embodiments of the present invention.

DETAILED DESCRIPTION OF PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and double prime notations are used to indicate similar elements in alternative embodiments.

FIGS. 2–10 illustrate an apparatus 20 for feeding and tabbing intermixed pieces of mail M according to first and second embodiments of the present invention. The apparatus 20 has intermixed mail feeding means, e.g., preferably provided by an intermixed mail feeder 30, for feeding a plurality of intermixed pieces of mail M having a plurality of different widths W, lengths L, and thicknesses T so that each of the plurality of intermixed pieces of mail M has a commonly-oriented edge E or side to be tabbed. For example, the thickness T can range from 0.007 to 0.25 inches, and the physical size or width W and length L dimensions can vary from 3.5 inches by 5.0 inches to 8.5 inches by 11.5 inches.

The commonly-oriented edge to be tabbed is preferably defined as the edge or side of a piece of mail M being generally perpendicular to the orientation of the address when reading the address A of the piece of mail M. In other words, when a piece of mail M, or the address label thereof, is properly oriented for displaying or reading the characters in a name and address sequence, the commonly oriented edge to be tabbed is generally perpendicular to this character or address sequence as illustrated. For example, the leading edge is preferably the right hand side when reading an address. This right hand side or front edge preferably is commonly oriented and fed first as the lead edge downstream in the apparatus 20. It will also be recognized by those skilled in the art that the addressed side of a piece of mail can be fed or positioned face down instead of face up as illustrated. The present invention, however, is also applicable to such orientation as well, e.g., the commonly-oriented edge to be tabbed is still generally perpendicular to the orientation of the address for reading purposes.

As also will be understood by those skilled in the art, the apparatus 20 enhances the speed and efficiency of mail M flowing downstream or through a mail handling or sorting operation such as associated with postal services. The feeding and tabbing apparatus 20 according to the present invention, for example, can seal mail M on the leading edge E or side for ease of handling or sorting such as with other automated mail handling and sorting equipment.

Figure 13:
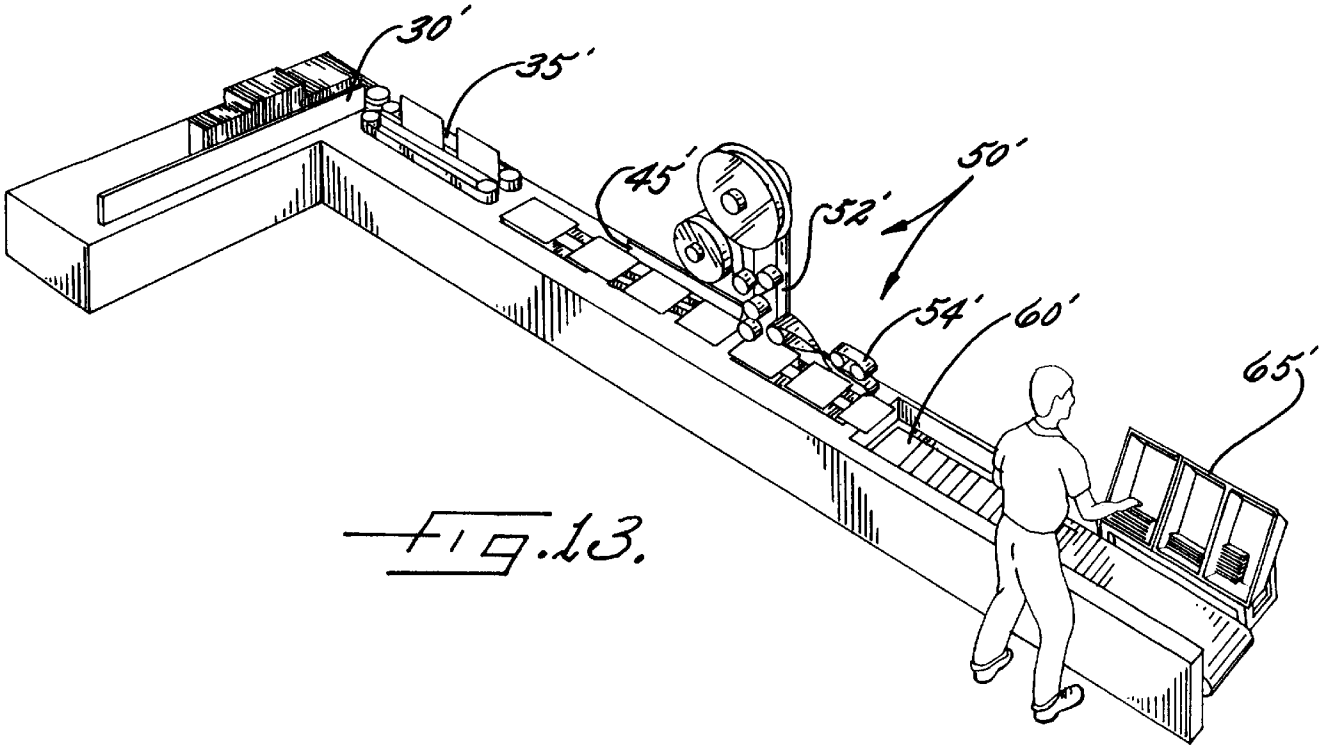
FIG. 13 is a perspective view of an apparatus for feeding and tabbing intermixed pieces of mail according to a fourth embodiment of the present invention.
Figure 14:
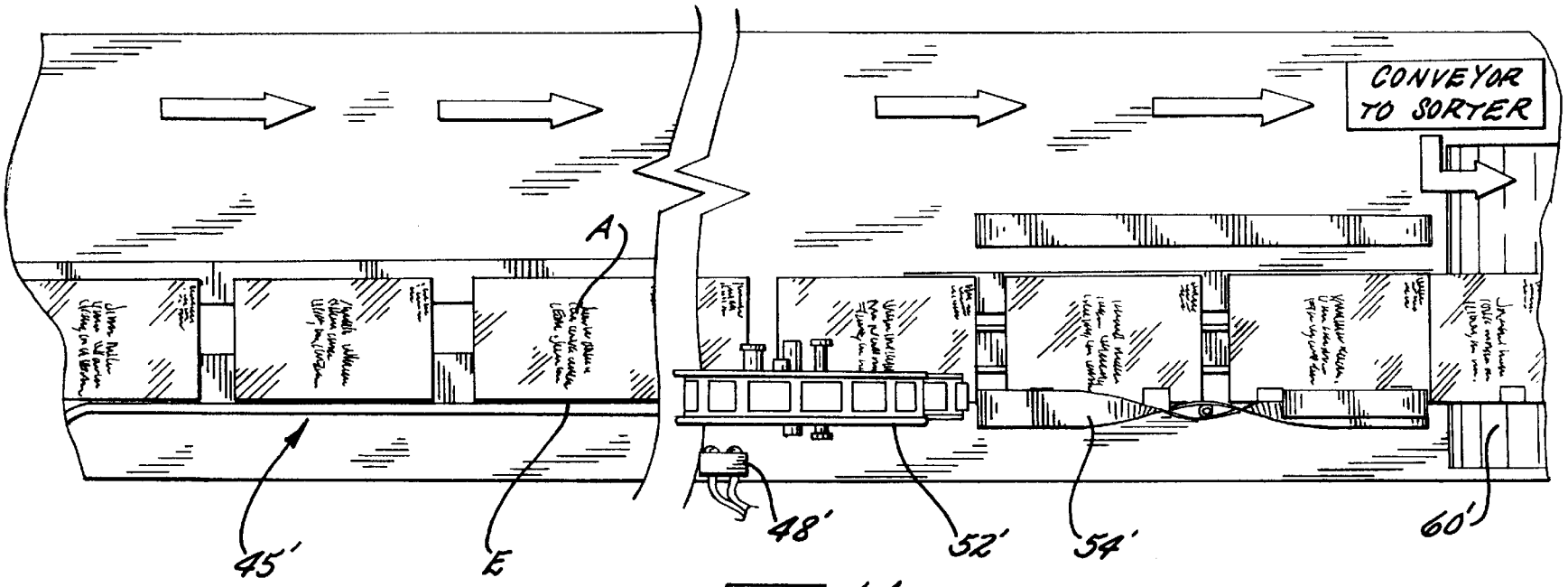
FIG. 14 is a fragmentary top plan view of an apparatus for feeding and tabbing intermixed pieces of mail having a tabber positioned on the right side thereof according to a third embodiment of the present invention.
Figure 15:
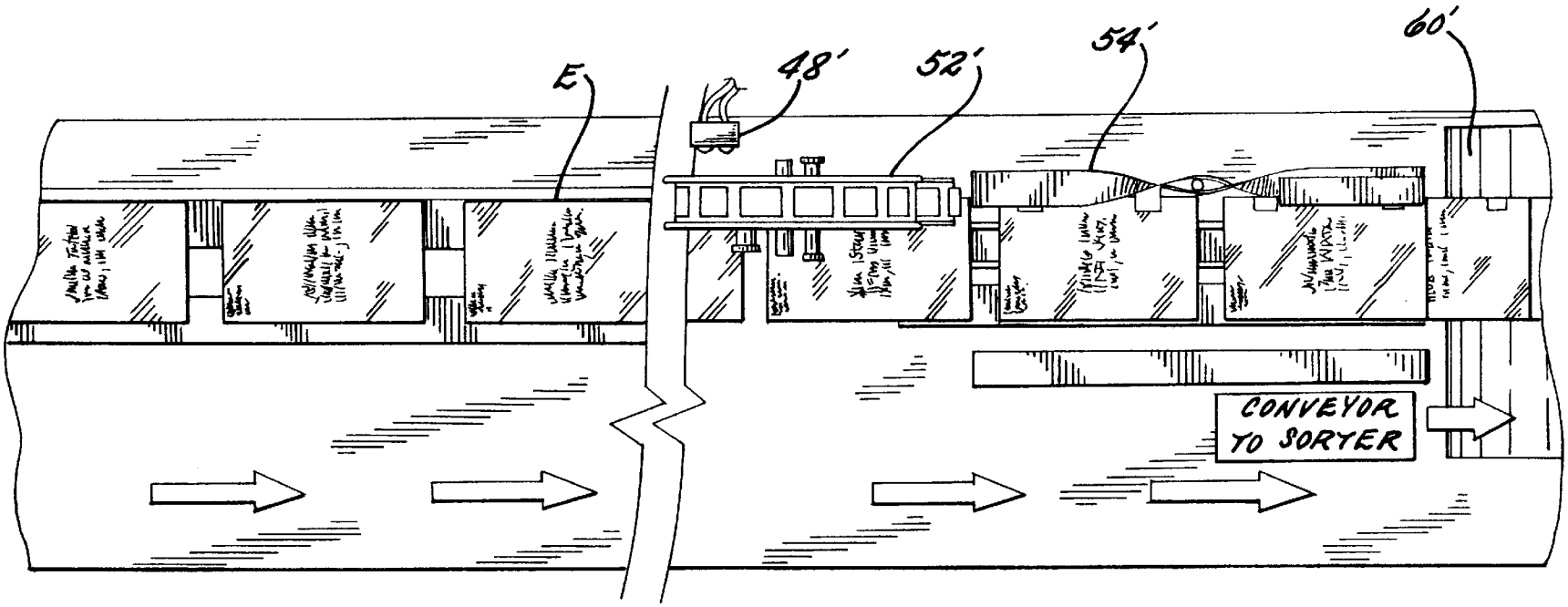
FIG. 15 is a fragmentary top plan view of an apparatus for feeding and tabbing intermixed pieces of mail having a tabber positioned on the left side thereof according to a fourth embodiment of the present invention.

The apparatus 20 also has first conveying means, e.g., provided by a first conveyor 35 or conveying portion, positioned downstream from the intermixed mail feeder 30 for conveying the plurality of intermixed pieces of mail M directly to a tabber 50 without rotation of each of the plurality of intermixed pieces of mail M. The first conveyor 35, for example, can either include an angled turn in the conveying of the pieces of intermixed mail (see FIG. 3) or can be more of a direct conveyance to the portion of the apparatus 20' applying the tab, e.g., a tabber 50" (see FIG. 13).

The apparatus 20 also has orienting means, e.g., a orientor 40 or rotator positioned downstream from the feeder 30 for orienting the plurality of intermixed pieces of mail M about a predetermined angle, e.g., preferably 90 degrees, of orientation prior to positioning at least one tab thereon. The orientor 40, in effect, is a "bump turn" or pivot point into which a piece of mail abuttingly contacts or bumps into, the contacting edge is stopped, and the mail piece is turned or rotated about the pivot point. Such an orientation 40 is illustrated in U.S. Pat. No. 5,393,366 which has the same assignee as the present application and which is incorporated herein by reference in its entirety.

The apparatus 20 also has the conveying means, e.g., a conveyor 35 or conveying portion such as a belt mounted on drive rolls and driven by one or more motors, positioned downstream from the orienting means 40 for conveying each of the plurality of intermixed positioned pieces of mail M downstream and registering means, e.g., provided by a mail register 45, positioned downstream from the conveying means 35 for re-registering or registering the plurality of intermixed pieces of mail M. The mail register 45 preferably includes a plurality of belts and a guide member which stops the pieces of mail so as to align the mail along a common edge or side.

The apparatus 20 further has tabbing means, e.g., preferably provided by a tabber 50, positioned downstream from the feeder 30 and directly aligned with and adjacent the commonly-oriented edge E to be tabbed for positioning at least one tab on each of the plurality of intermixed pieces of mail M. The tabber 50 advantageously can eject or place more than one tab onto a piece of mail M. A sensor 48, such as a photocell or photodiode array, preferably senses a length of the edge E to be tabbed of each of the intermixed pieces of mail and converts the sensed length to encoder counts. These encoder counts are then used to determine the position of the tab. For example, if the side or edge E to be tabbed is less than a predetermined length, e.g., 4 inches, then only one tab will be placed on the piece of mail M in the center of the piece (see, e.g., FIG. 17). On the other hand, if the side or edge E to be tabbed is greater than or equal to the predetermined length, e.g., 4 inches, then a pair of tabs can be place on the piece of mail M with each tab respectively positioned about 1 inch from the two corners or ends along the side or edge of the piece of mail M.

As perhaps best illustrated in FIGS. 7–9, the tabber 50 also preferably includes dispensing means, e.g., a tab dispenser 52, for dispensing the at least one tab onto each of the plurality of intermixed pieces of mail M so that the dispensed tab extends about half off an outer surface of the piece of mail M at the commonly-oriented edge to be tabbed and wrapping means, e.g., a tab wrapper 54, positioned downstream from the tab dispenser for wrapping or folding the tab around the commonly-oriented edge to be tabbed as each of the plurality of intermixed pieces of mail travels downstream along a predetermined path of travel. If the edge is unsealed or open, then the wrapping or folding preferably closes or seals the unsealed or open edge.

An example of an orientor 45 or rotator and a tabber 50 for the apparatus 20 can be seen in U.S. Pat. No. 5,393,366 which has a common assignee as the present application and which is incorporated herein in its entirety by reference Also, the apparatus 20' advantageously can also be made without the orientor or rotator 45 as illustrated in FIGS. 12–15. For example, as illustrated by the table in FIG. 16, depending on the location or positioning of the commonly-oriented edges E, e.g., front, rear, top, and bottom of the pieces of mail M, an orientor or rotator 45 may or may not be preferable and the side, e.g., left or right, of the tabber 50 along or adjacent the conveyor 35. It will be understood by those skilled in the art that the front is preferably the lead edge, and the rear is preferably the trail edge. The bottom is preferably the folded edge or spine, and the top is preferably the side opposite the folded edge. Nevertheless, depending on the type and shape of the mail, and a desired nomenclature, this description of the edges of the pieces of mail as set forth in FIG. 16 can vary according to the present invention.

Figure 1:
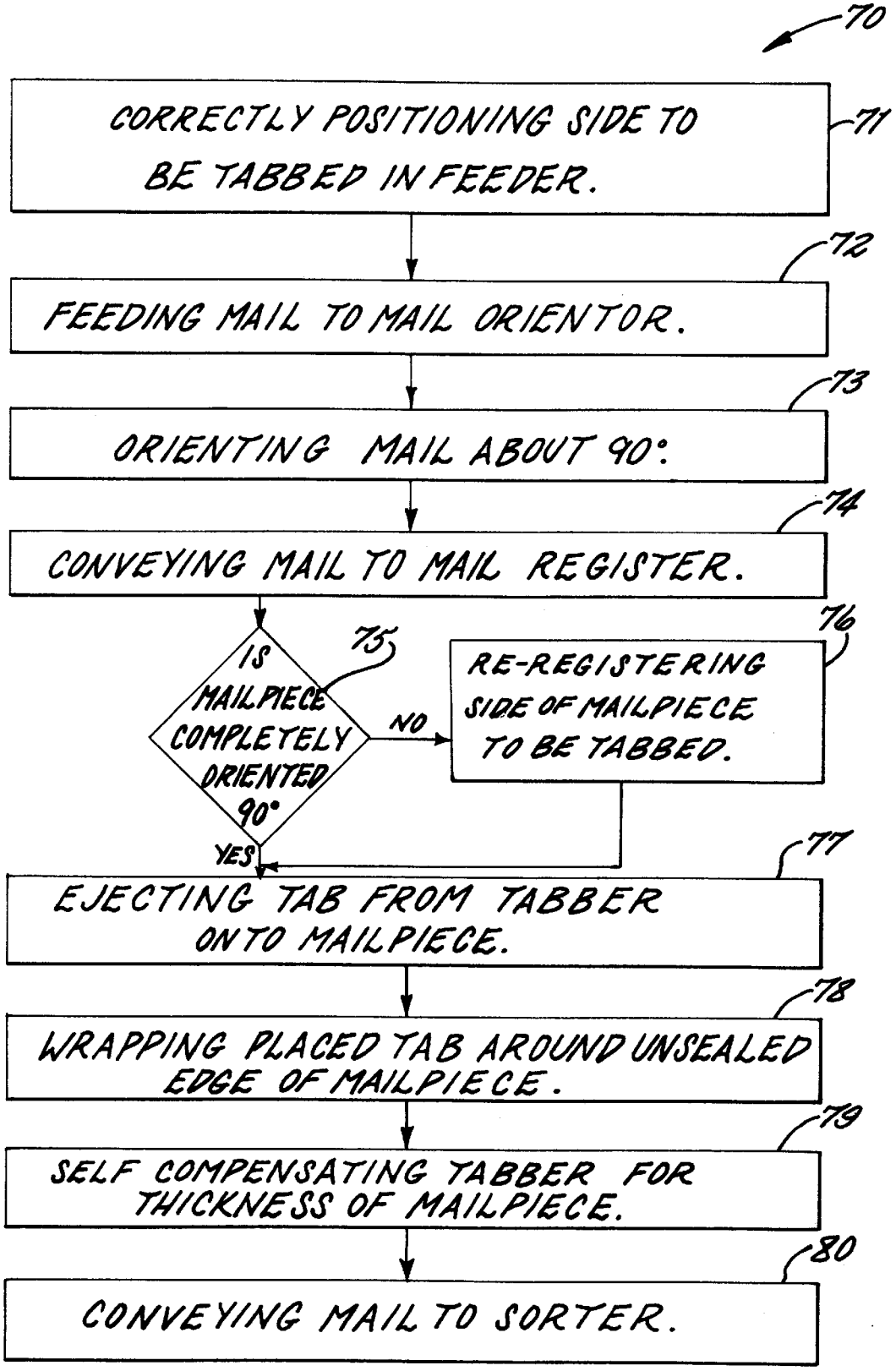
FIG. 1 is a schematic flow diagram of a method of feeding and tabbing intermixed pieces of mail according to first and second embodiments of the present invention.
Figure 2:
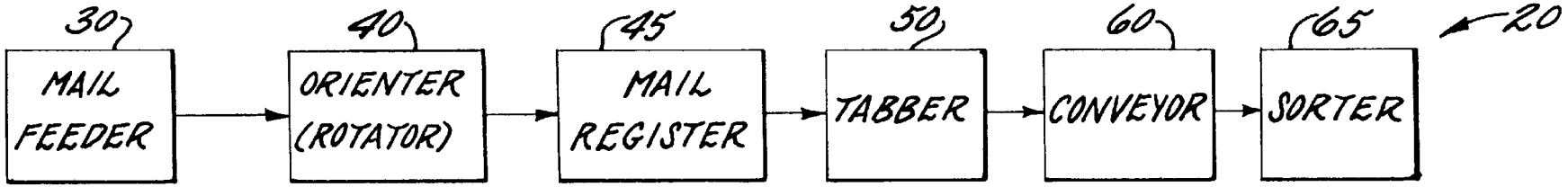
FIG. 2 is a schematic diagram of an apparatus for feeding and tabbing intermixed pieces of mail according to first and second embodiments of the present invention.
Figure 3:
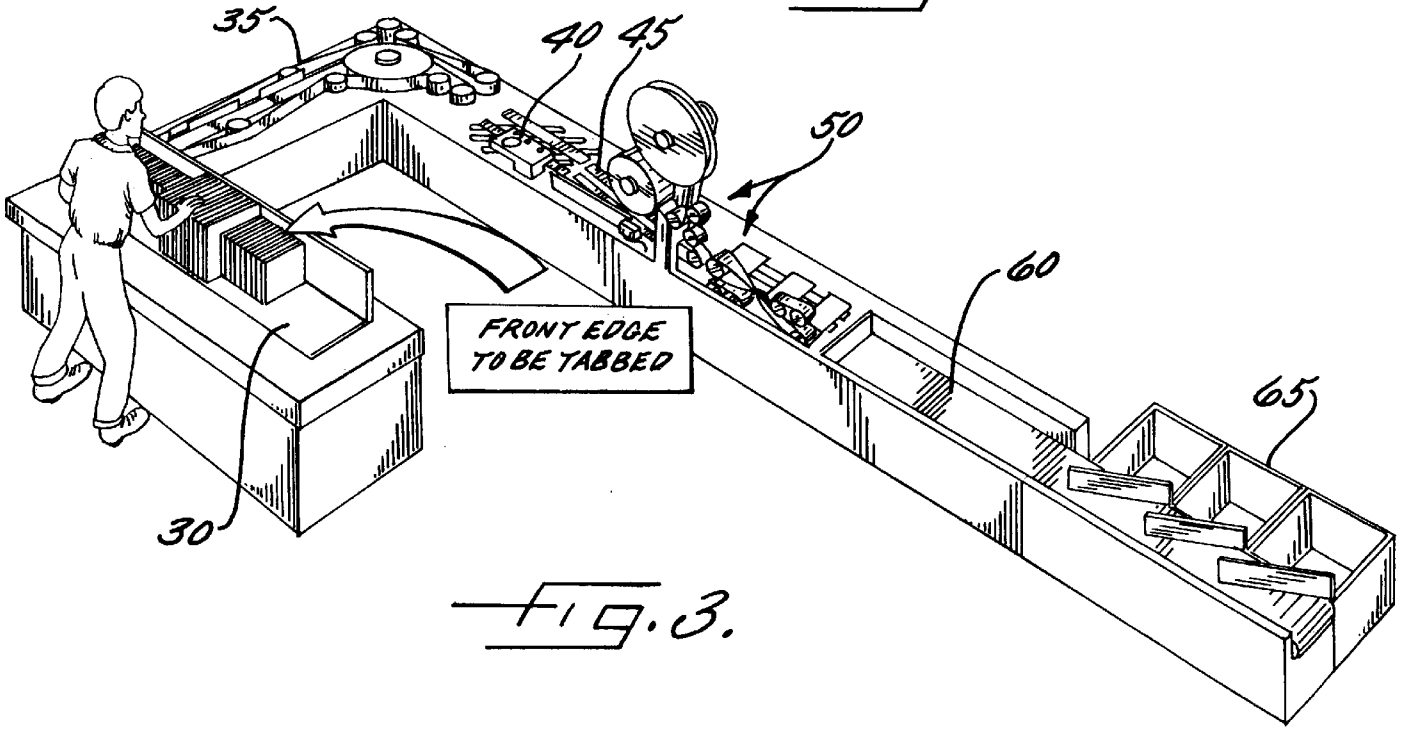
FIG. 3 is a perspective view of an apparatus for feeding and tabbing intermixed pieces of mail according to a first embodiment of the present invention.
Figure 5:
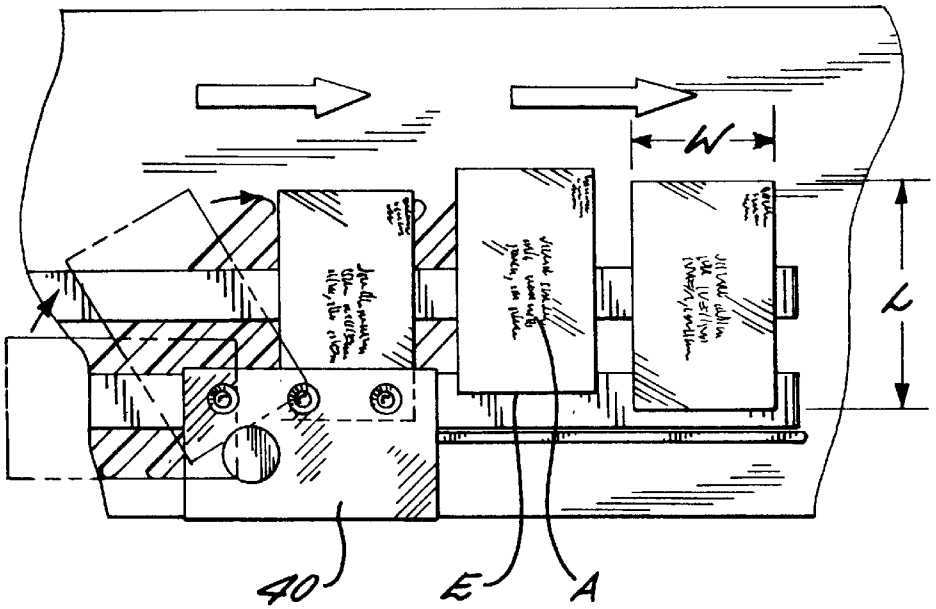
FIG. 5 is a fragmentary top plan view of an apparatus for feeding and tabbing intermixed pieces of mail and illustrating mail being rotated or oriented according to a first embodiment of the present invention.
Figure 4:
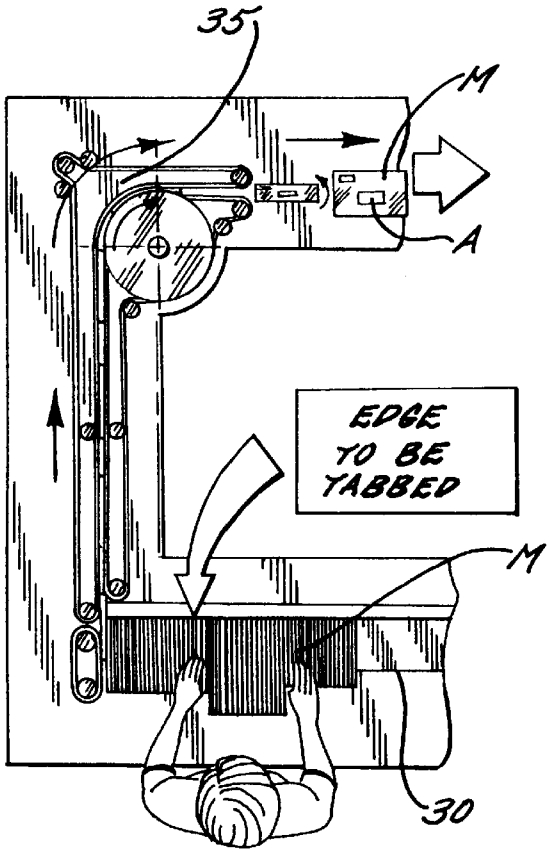
FIG. 4 is a fragmentary top plan view of an apparatus for feeding and tabbing intermixed pieces of mail and illustrating mail being fed and conveyed according to a first embodiment of the present invention.
Figure 10:
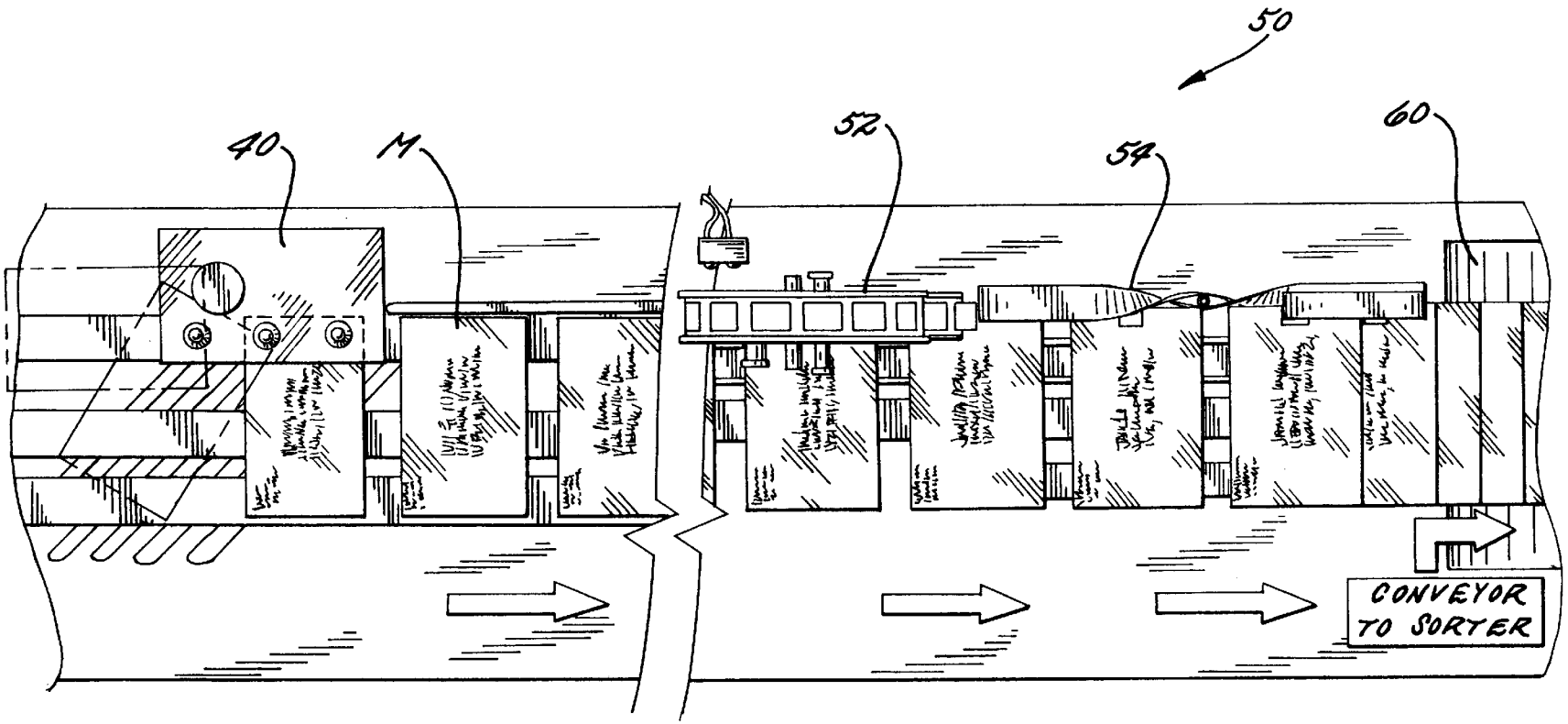
FIG. 10 is a fragmentary top plan view of an apparatus for feeding and tabbing intermixed pieces of mail and illustrating mail being rotated and tabbed having a tabber on the left side thereof according to a second embodiment of the present invention.

As illustrated in FIGS. 1–17, the present invention provides methods of feeding and tabbing intermixed pieces of mail M. As perhaps best illustrated in FIG. 1, a method 70 of feeding and tabbing intermixed pieces of mail M preferably includes correctly positioning a plurality of intermixed pieces of mail M having a plurality of different widths W, lengths L, and thicknesses T so that each of the plurality of intermixed pieces of mail M has a commonly-oriented edge E or side to be tabbed (Block 71). The commonly-oriented edge E to be tabbed is preferably defined as the right side of a piece of mail M when reading the address of the piece of mail M. The mail M is then fed downstream along the first conveyor 35 to the intermixed mail orientor 40 (Block 72) The intermixed mail orientor 40, as described above, orients the mail M about a predetermined angle (Block 73). For rectangular-shaped mail, for example, this angle is preferably about 90 degrees and the mail M is preferably rotated so that the edge E or side to be tabbed is now positionally aligned with the tabber 50.

The oriented or rotated mail M is then conveyed or transported downstream to the mail register 45 (Block 74). A determination can then be made as to whether each piece of mail M is properly aligned or rotated (Block 75). If the conveyed pieces of intermixed mail M are not completely oriented or aligned about the 90 degree angle, for example, then the pieces of mail M are re-registered for alignment purposes prior to engagement with the tabber 50 (Block 76).

The method also includes positioning or placing at least one tab onto, e.g., an outer surface, each of the plurality of intermixed pieces of mail M (Blocks 77, 78). The tabber 50 is selectively adjusted or self-compensated for the thickness T of each of the pieces of mail M (Block 77) The tabbed mail M is then conveyed downstream to be sorted or to a sorter 65 (Block 80) where the mail M is manually or automatically sorted. The positioning of the at least one tab preferably includes dispensing or ejecting the at least one tab onto each of the plurality of intermixed pieces of mail M so that the dispensed tab extends about half off the surface of the piece of mail M at the commonly-oriented edge E to be tabbed (Block 77 the tabber 50 is selectively adjusted or self-compensated for the thickness T of each of the pieces of mail M (Block 77) and wrapping the tab around the commonly-oriented edge E to be tabbed (Block 78) as each of the plurality of intermixed pieces of mail M travels downstream along a predetermined path of travel (see arrows).

Figure 11:
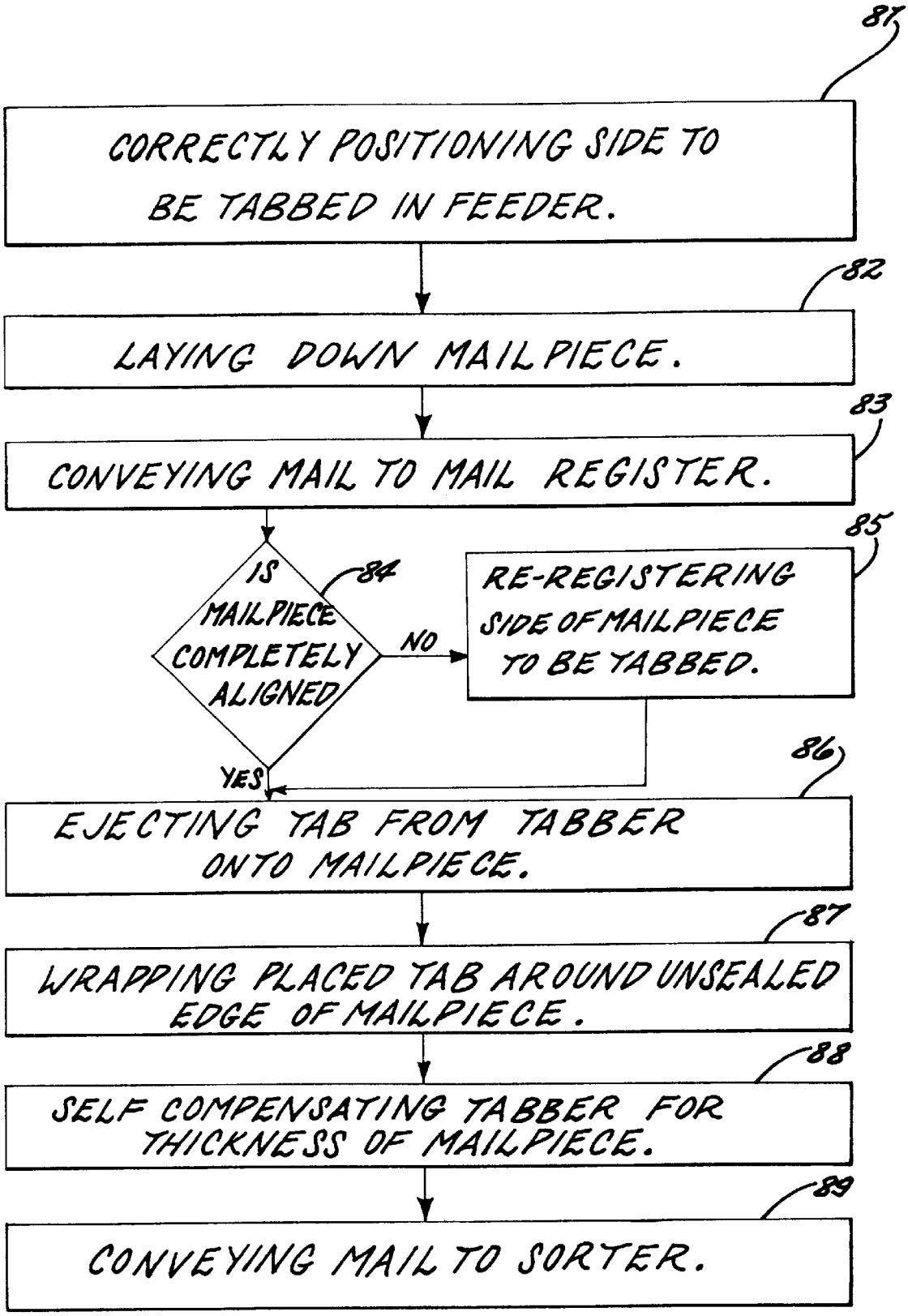
FIG. 11 is a schematic flow diagram of a method of feeding and tabbing intermixed pieces of mail according to third and fourth embodiments of the present invention.
Figure 12:
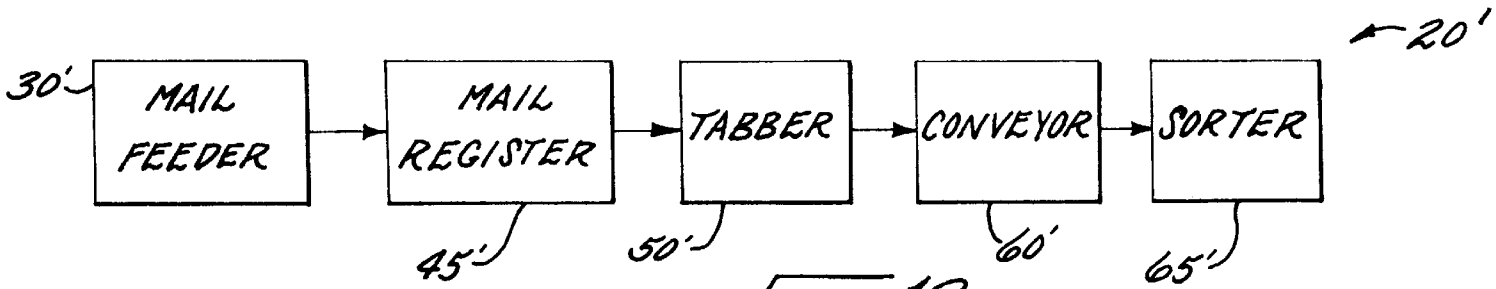
FIG. 12 is a schematic diagram of an apparatus for feeding and tabbing intermixed pieces of mail according to third and fourth embodiments of the present invention.

As perhaps best illustrated in FIG. 11, another method of feeding and tabbing intermixed pieces of mail M according to the present invention preferably includes providing a feeder 30' for feeding a plurality of intermixed pieces of mail M downstream and correctly positioning a plurality of intermixed pieces of mail M having a plurality of different widths W, lengths L, and thicknesses T so that each of the plurality of intermixed pieces of mail M has a commonly-oriented edge E or side to be tabbed (Block 81). The method also preferably includes laying down each piece of mail when conveyed or positioned in a generally vertical orientation (Block 82) positioning a tabber 50' downstream from the feeder 30' and directly aligned with and adjacent the commonly-oriented edge E to be tabbed. The intermixed pieces of mail M are conveyed from the feeder 30' downstream to a mail register 45', and also preferably to the tabber 50', without rotating each of the plurality of pieces of mail M (Block 83).

A determination can then be made as to whether each piece of mail M is properly aligned or rotated (Block 84). If the conveyed pieces of intermixed mail M are not completely oriented or aligned about the 90 degree angle, for example, then the pieces of mail M are re-registered for alignment purposes prior to engagement with the tabber 50' (Block 85). The method also includes positioning or placing at least one tab on each of the plurality of intermixed pieces of mail M (Blocks 86, 87), selectively adjusting or self-compensating the tabber 50' for the thickness of each of the pieces of mail M (Block 88), and conveying the tabbed mail M downstream to be sorted or to a sorter 65' (Block 89) where the mail M is manually or automatically sorted.

Yet another method of feeding and tabbing intermixed pieces of mail M according to the present invention preferably includes providing a feeder 30 for feeding a plurality of intermixed pieces of mail M downstream and positioning a plurality of intermixed pieces of mail M having a plurality of different widths W, lengths L, and thicknesses T in the feeder 30 so that each of the plurality of intermixed pieces of mail M has a commonly-oriented edge E to be tabbed. The positioning of the plurality of intermixed pieces preferably includes aligning each of the plurality of intermixed pieces of mail M so that the lead edge E being fed downstream comprises the commonly-oriented edge to be tabbed The method also preferably includes positioning at least one tab on each of the plurality of intermixed pieces of mail M.

A further method of feeding and tabbing intermixed pieces of mail M according to the present invention preferably includes providing a feeder 30 for feeding a plurality of intermixed pieces of mail M downstream and positioning a plurality of intermixed pieces of mail M having a plurality of different widths W, lengths L, and thicknesses T in the feeder 30 so that each of the plurality of intermixed pieces of mail M has a commonly-oriented unsealed edge E to be tabbed. The commonly-oriented unsealed edge E to be tabbed is preferably defined as the right side of a piece of mail M when reading the address of the piece of mail M or a side generally perpendicular to the address orientation. The positioning of the plurality of intermixed pieces preferably includes aligning each of the plurality of intermixed pieces of mail M so that the lead edge E being fed downstream comprises the commonly-oriented unsealed edge E to be tabbed. The method also preferably includes conveying each of the plurality of intermixed and aligned pieces of mail M downstream and positioning at least one tab on each of the plurality of intermixed pieces of mail M.

Figure 17:
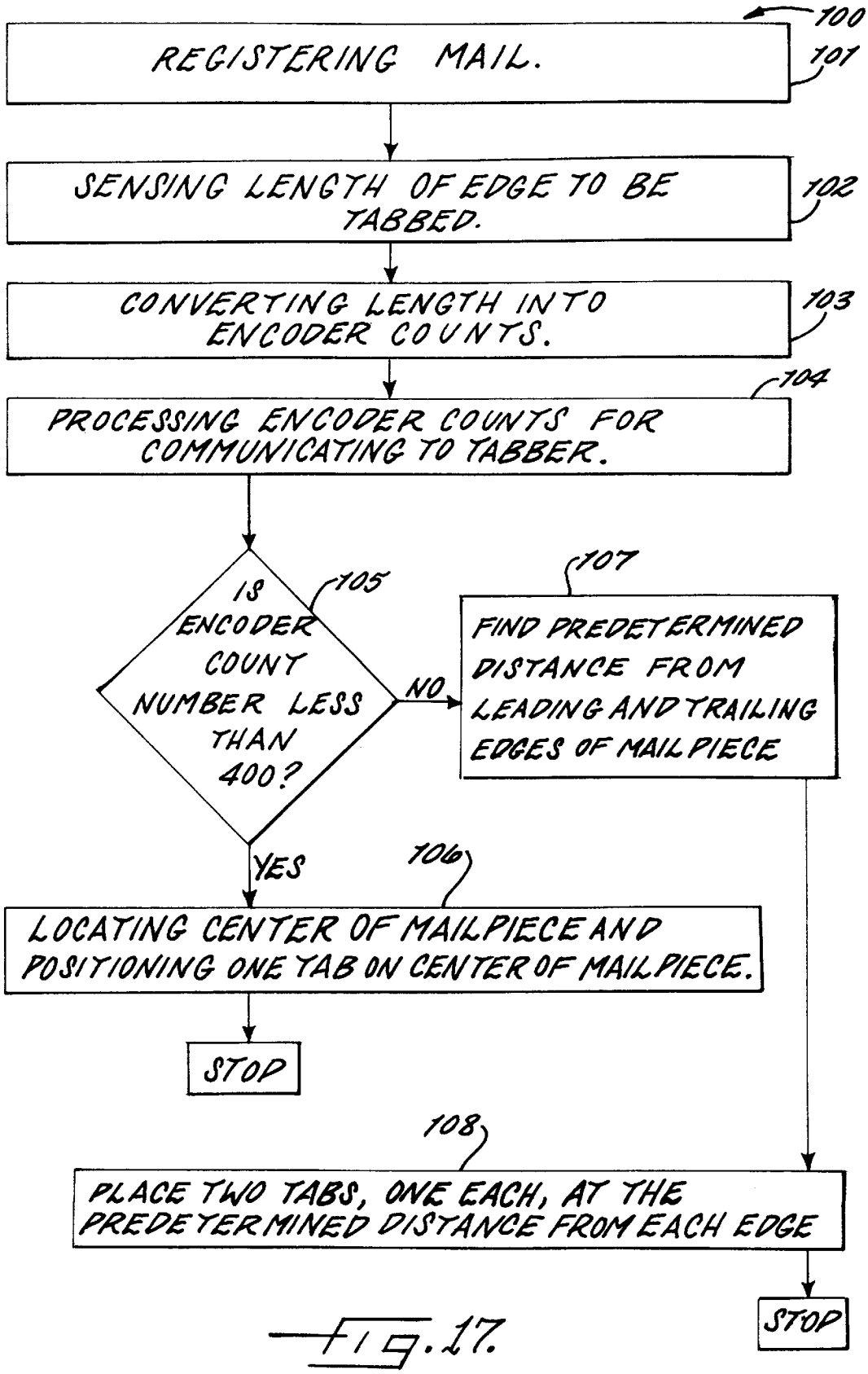
FIG. 17 is a schematic flow diagram of a method of sensing and tabbing intermixed pieces of mail for an apparatus for feeding and tabbing intermixed pieces of mail according to embodiments of the present invention.

As perhaps best illustrated in FIG. 17, the present invention also advantageously includes a method of tabbing a plurality of intermixed pieces of mail. The method preferably includes registering each of the plurality intermixed pieces of mail, if needed (Block 101) and sensing the length of each edge to be tabbed of a plurality of intermixed pieces of mail (Block 102). The intermixed pieces of mail preferably have at least a plurality of lengths and widths. The method also includes locating at least one predetermined region of each edge to be tabbed of the plurality of intermixed pieces of mail responsive to the length thereof and positioning at least one tab onto each of the plurality of intermixed pieces of mail at the at least one predetermined region (Blocks 106, 108).

The method can also include the locating step including locating a center region of the edge to be tabbed of the mailpiece responsive to the length of the mailpiece being less than a predetermined length (Block 105). Also, the locating step can include locating a first region of an edge to be tabbed a predetermined distance from a first end thereof and locating a second region of an edge to be tabbed a predetermined distance from a second end thereof both responsive to the length of the mail piece being greater than the predetermined length (Block 107). The method can additionally include converting the sensed length to a number of processing or encoder counts (Block 103), e.g., digital signals, and processing the encoder counts to locate the regions for tabbing (Block 104).

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed:

1. A method of feeding and tabbing intermixed pieces of mail comprising the steps of:

positioning a plurality of intermixed pieces of mail having a plurality of different widths, lengths, and thicknesses so that each of the plurality of intermixed pieces of mail has a commonly-oriented edge to be tabbed, the commonly-oriented edge to be tabbed being defined as being generally perpendicular to the address orientation of a piece of mail when reading the address of the piece of mail; and positioning at least one tab on each of the plurality of intermixed pieces of mail by dispensing the at least one tab onto each of the plurality of intermixed pieces of mail so that a portion of the dispensed tab extends off an outer surface of the piece of mail at the commonly-oriented edge to be tabbed and wrapping the tab around the commonly-oriented edge to be tabbed as each of the plurality of intermixed pieces of mail travels downstream along a predetermined path of travel.

2. A method as defined in claim 1, further comprising orienting the plurality of intermixed pieces of mail about a predetermined angle of orientation prior to the step of positioning the at least one tab.

3. A method as defined in claim 2, further comprising conveying each of the plurality of intermixed positioned pieces of mail to a mail register after the orienting step and registering the plurality of intermixed pieces of mail.

4. A method as defined in claim 3, wherein the step of registering the plurality of intermixed pieces of mail includes aligning each of the commonly-oriented edges of the plurality of intermixed pieces of mail if the mail piece is not completely oriented about the predetermined angle.

5. A method as defined in claim 1, further comprising adjusting for thickness of each of the plurality of intermixed pieces of mail after the step of positioning at least one tab thereon.

6. A method as defined in claim 5, further comprising sorting each of the plurality of tabbed intermixed pieces of mail.

7. A method as defined in claim 1, wherein the step of positioning the at least one tab includes dispensing the at least one tab onto each of the plurality of intermixed pieces of mail so that the dispensed tab extends about half off an outer surface of the piece of mail at the commonly-oriented edge to be tabbed.

8. A method as defined in claim 2, further comprising the step of providing a feeder for feeding the plurality of intermixed pieces of mail downstream prior to the step of positioning the plurality of intermixed pieces of mail, and wherein the positioning of the plurality of intermixed pieces includes aligning each of the plurality of intermixed pieces of mail so that the lead edge being fed downstream comprises the commonly-oriented edge to be tabbed.

9. A method as defined in claim 1, further comprising the step of providing a feeder for feeding the plurality of intermixed pieces of mail downstream prior to the step of positioning the plurality of intermixed pieces of mail and positioning a tabber downstream from the feeder and directly aligned with and adjacent the commonly-oriented edge to be tabbed.

10. A method as defined in claim 1, further comprising conveying the plurality of intermixed pieces of mail downstream in a stand-up position for a predetermined distance and then laying down the plurality of intermixed pieces of mail prior to the step of positioning at least one tab.

11. A method of feeding and tabbing intermixed pieces of mail comprising the steps of: providing a feeder for feeding a plurality of intermixed pieces of mail downstream;

positioning a plurality of intermixed pieces of mail having a plurality of different widths, lengths, and thicknesses so that each of the plurality of intermixed pieces of mail has a commonly-oriented edge to be tabbed;

positioning a tabber downstream from the feeder and directly aligned with and adjacent the commonly-oriented edge to be tabbed of the plurality of intermixed pieces of mail;

conveying the plurality of intermixed pieces of mail downstream to the tabber without rotating each of the plurality of pieces of mail; and positioning at least one tab on each of the plurality of intermixed pieces of mail being conveyed by dispensing the at least one tab onto each of the plurality of intermixed pieces of mail so that a portion of the dispensed tab extends off an outer surface of the piece of mail at the commonly-oriented edge to be tabbed and wrapping the tab around the commonly-oriented edge to be tabbed as each of the plurality of intermixed pieces of mail travels downstream along a predetermined path of travel.

12. A method as defined in claim 11, further comprising sensing a length of the commonly-oriented edge to be tabbed of each of the plurality of intermixed pieces of mail prior to the step of positioning the at least one tab.

13. A method as defined in claim 12, further comprising conveying each of the plurality of intermixed positioned pieces of mail to a mail register after the orienting step and registering the plurality of intermixed pieces of mail.

14. A method as defined in claim 13, wherein the step of registering the plurality of intermixed pieces of mail includes aligning each of the commonly-oriented edges of the plurality of intermixed pieces of mail if the mail piece is not completely oriented about the predetermined angle.

15. A method as defined in claim 14, further comprising adjusting for thickness of each of the plurality of intermixed pieces of mail after the step of positioning at least one tab thereon.

16. A method as defined in claim 15, further comprising sorting each of the plurality of tabbed intermixed pieces of mail.

17. A method as defined in claim 16, wherein the step of positioning the at least one tab includes dispensing the at least one tab onto each of the plurality of intermixed pieces of mail so that the dispensed tab extends about half off an outer surface of the piece of mail at the commonly-oriented edge to be tabbed.

18. A method as defined in claim 17, further comprising conveying the plurality of intermixed pieces of mail downstream in a stand-up position for a predetermined distance and then laying down the plurality of intermixed pieces of mail prior to the step of positioning at least one tab.

19. A method as defined in claim 18, wherein the commonly-oriented edge to be tabbed being defined as the side of a piece of mail being generally perpendicular to the address orientation when reading the address of the piece of mail.

20. A method of feeding and tabbing intermixed pieces of mail comprising the steps of:

providing a feeder for feeding a plurality of intermixed pieces of mail downstream;

positioning a plurality of intermixed pieces of mail having a plurality of different widths, lengths, and thicknesses in the feeder so that each of the plurality of intermixed pieces of mail has a commonly-oriented edge to be tabbed, the positioning of the plurality of intermixed pieces including aligning each of the plurality of intermixed pieces of mail so that the lead edge being fed downstream comprises the commonly-oriented edge to be tabbed; and positioning at least one tab on each of the plurality of intermixed pieces of mail by dispensing the at least one tab onto each of the plurality of intermixed pieces of mail so that a portion of the dispensed tab extends off an outer surface of the piece of mail at the commonly-oriented edge to be tabbed and wrapping the tab around the commonly-oriented edge to be tabbed as each of the plurality of intermixed pieces of mail travels downstream along a predetermined path of travel.

21. A method as defined in claim 20, further comprising orienting the plurality of intermixed pieces of mail about a predetermined angle of orientation prior to the step of positioning the at least one tab.

22. A method as defined in claim 21, further comprising conveying each of the plurality of intermixed positioned pieces of mail to a mail register after the orienting step and registering the plurality of intermixed pieces of mail.

23. A method as defined in claim 22, wherein the step of registering the plurality of intermixed pieces of mail includes aligning each of the commonly-oriented edges of the plurality of intermixed pieces of mail if the mail piece is not completely oriented about the predetermined angle.

24. A method as defined in claim 23, further comprising adjusting for thickness of each of the plurality of intermixed pieces of mail after the step of positioning at least one tab thereon.

25. A method as defined in claim 24, further comprising sorting each of the plurality of tabbed intermixed pieces of mail.

26. A method as defined in claim 25, wherein the step of positioning the at least one tab includes dispensing the at least one tab onto each of the plurality of intermixed pieces of mail so that the dispensed tab extends about half off the surface of the piece of mail at the commonly-oriented edge to be tabbed.

27. A method as defined in claim 26, further comprising conveying the plurality of intermixed pieces of mail downstream in a stand-up position for a predetermined distance and then laying down the plurality of intermixed pieces of mail prior to the step of positioning at least one tab.

28. A method as defined in claim 27, wherein the commonly-oriented edge to be tabbed being defined as the side of a piece of mail being generally perpendicular to the address orientation when reading the address of the piece of mail.

29. A method of feeding and tabbing intermixed pieces of mail comprising the steps of:

providing a feeder for feeding a plurality of intermixed pieces of mail downstream;

positioning a plurality of intermixed pieces of mail having a plurality of different widths, lengths, and thicknesses in the feeder so that each of the plurality of intermixed pieces of mail has a commonly-oriented unsealed edge to be tabbed, the commonly-oriented unsealed edge to be tabbed being defined as the side of a piece of mail being generally perpendicular to the address orientation when reading the address of the piece of mail, the positioning of the plurality of intermixed pieces including aligning each of the plurality of intermixed pieces of mail so that the lead edge being fed downstream comprises the commonly-oriented unsealed edge to be tabbed;

conveying each of the plurality of intermixed and aligned pieces of mail downstream; and positioning at least one tab on each of the plurality of intermixed pieces of mail by dispensing the at least one tab onto each of the plurality of intermixed pieces of mail so that a portion of the dispensed tab extends off an outer surface of the piece of mail at the commonly-oriented edge to be tabbed and wrapping the tab around the commonly-oriented edge to be tabbed as each of the plurality of intermixed pieces of mail travels downstream along a predetermined path of travel.

30. A method as defined in claim 29, further comprising orienting the plurality of intermixed pieces of mail about a predetermined angle of orientation prior to the step of positioning the at least one tab.

31. A method as defined in claim 30, further comprising conveying each of the plurality of intermixed positioned pieces of mail to a mail register after the orienting step and registering the plurality of intermixed pieces of mail.

32. A method as defined in claim 31, wherein the step of registering the plurality of intermixed pieces of mail includes aligning each of the commonly-oriented edges of the plurality of intermixed pieces of mail if the mail piece is not completely oriented about the predetermined angle.

33. A method as defined in claim 29, further comprising adjusting for the plurality of different thicknesses of each of the plurality of intermixed pieces of mail after the step of positioning at least one tab thereon.

34. A method as defined in claim 29, further comprising sorting each of the plurality of tabbed intermixed pieces of mail.

35. A method as defined in claim 29, wherein the step of positioning the at least one tab includes dispensing the at least one tab onto each of the plurality of intermixed pieces of mail so that the dispensed tab extends about half off an outer surface of the piece of mail at the commonly-oriented edge to be tabbed.

36. A method as defined in claim 29, wherein the conveying step includes transporting the plurality of intermixed pieces of mail downstream in a stand-up position for a predetermined distance and then laying down the plurality of intermixed pieces of mail prior to the step of positioning at least one tab.

37. An apparatus for feeding and tabbing intermixed pieces of mail, the apparatus comprising:

intermixed mail feeding means for feeding a plurality of intermixed pieces of mail having a plurality of different widths, lengths, and thicknesses so that each of the plurality of intermixed pieces of mail has a commonly-oriented edge to be tabbed, the commonly-oriented edge to be tabbed being defined as the side of a piece of mail being generally perpendicular to the address orientation when reading the address of the piece of mail; and tabbing means positioned downstream from said feeding means and directly aligned with and adjacent the commonly-oriented edge to be tabbed for positioning at least one tab on each of the plurality of intermixed pieces of mail wherein said tabbing means includes dispensing means for dispensing the at least one tab onto each of the plurality of intermixed pieces of mail so that a portion of the dispensed tab extends off the outer surface of the piece of mail at the commonly-oriented edge to be tabbed and wrapping means positioned downstream from said dispensing means for wrapping the tab around the commonly-oriented edge to be tabbed as each of the plurality of intermixed pieces of mail travels downstream along a predetermined path of travel.

38. An apparatus as defined in claim 37, further comprising first conveying means positioned downstream from said intermixed mail feeding means for conveying the plurality of intermixed pieces of mail directly to said tabbing means without rotation of each of the plurality of intermixed pieces of mail.

39. An apparatus as defined in claim 37, further comprising orienting means positioned downstream from said feeding means for orienting the plurality of intermixed pieces of mail about a predetermined angle of orientation prior to positioning the at least one tab.

40. An apparatus as defined in claim 39, further comprising second conveying means positioned downstream from said orienting means for conveying each of the plurality of intermixed positioned pieces of mail to a mail register and registering means positioned downstream from said conveying means for registering the plurality of intermixed pieces of mail.

* * * * *

UNITED STATES PATENT AND TRADEMARK OFFICE

CERTIFICATE OF CORRECTION

PATENT NO. : 6,196,392 B1
DATED : March 6, 2001
INVENTOR(S) : Lopez et al.

It is certified that error appears in the above-identified patent and that said Letters Patent is hereby corrected as shown below:

Column 5,
Line 64, delete "place" and insert -- place -- therfor.

Column 6,
Line 17, after "reference" please insert -- . --.

Column 7,
Line 55, after "tabbed" please insert -- . --.

Signed and Sealed this

Sixteenth Day of October, 2001

*Attest:*

Nicholas P. Godici

*Attesting Officer*

NICHOLAS P. GODICI
*Acting Director of the United States Patent and Trademark Office*